US006971354B1

(12) United States Patent
Smith et al.

(10) Patent No.: US 6,971,354 B1
(45) Date of Patent: Dec. 6, 2005

(54) VARIABLE CAMSHAFT TIMING SYSTEM WITH REMOTELY LOCATED CONTROL SYSTEM

(75) Inventors: Franklin R. Smith, Cortland, NY (US); Braman Wing, Interlaken, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/017,605

(22) Filed: Dec. 20, 2004

(51) Int. Cl.[7] ..... F01L 1/34

(52) U.S. Cl. ..... 123/90.17; 123/90.15; 123/90.31

(58) Field of Search ..... 123/90.17, 90.15, 123/90.31

(56) References Cited

U.S. PATENT DOCUMENTS

| | | | | |
|---|---|---|---|---|
| 5,002,023 | A | 3/1991 | Butterfield et al. | 123/90.15 |
| 5,046,460 | A | 9/1991 | Butterfield et al. | 123/90.17 |
| 5,107,804 | A | 4/1992 | Becker et al. | 123/90.17 |
| 5,107,805 | A | 4/1992 | Butterfield et al. | 123/90.17 |
| 5,172,659 | A | 12/1992 | Butterfield et al. | 123/90.17 |
| 5,184,578 | A | 2/1993 | Quinn, Jr. et al. | 123/90.17 |
| 5,289,805 | A | 3/1994 | Quinn, Jr. et al. | 123/90.17 |
| 5,361,735 | A | 11/1994 | Butterfield et al. | 123/90.17 |
| 5,417,241 | A | 5/1995 | Tischer et al. | 137/596.17 |
| 5,497,738 | A | 3/1996 | Siemon et al. | 123/90.17 |
| 5,657,725 | A | 8/1997 | Butterfield et al. | 123/90.17 |
| 6,129,060 | A | 10/2000 | Koda | 123/90.17 |
| 6,129,062 | A | 10/2000 | Koda | 123/90.17 |
| 6,247,434 | B1 | 6/2001 | Simpson et al. | 123/90.17 |
| 6,250,265 | B1 | 6/2001 | Simpson | 123/90.17 |
| 6,263,846 | B1 | 7/2001 | Simpson et al. | 123/90.17 |
| 6,311,655 | B1 | 11/2001 | Simpson et al. | 123/90.17 |
| 6,374,787 | B2 | 4/2002 | Simpson et al. | 123/90.17 |
| 6,481,402 | B1 * | 11/2002 | Simpson et al. | 123/90.17 |
| 6,532,922 | B2 | 3/2003 | Komazawa | 120/90.17 |
| 6,691,656 | B1 * | 2/2004 | Pierik et al. | 123/90.17 |
| 6,763,791 | B2 | 7/2004 | Gardner et al. | 123/90.17 |
| 2003/0070639 | A1 * | 4/2003 | Kohrs | 123/90.17 |
| 2003/0070713 | A1 | 4/2003 | Cornea et al. | 137/512.15 |

FOREIGN PATENT DOCUMENTS

| | | | | |
|---|---|---|---|---|
| JP | 07280788 | A | 10/1995 | G01N 30/32 |
| JP | 11013430 | A | 1/1999 | F01L 1/34 |

OTHER PUBLICATIONS

Automotive Handbook, Bosch, "Electrohydraulic Pumps and Small Units", pp. 634-637.

Pictorial Handbook of Technical Devices, Grafstein et al, "C-Valves", 2 pages.

* cited by examiner

*Primary Examiner*—Thomas Denion
*Assistant Examiner*—Zelalem Eshete
(74) *Attorney, Agent, or Firm*—Brown & Michaels, PC; Greg Dziegielewski

(57) ABSTRACT

A VCT system for an internal combustion engine having at least one camshaft and a VCT phaser mounted to the camshaft. The phaser having a plurality of advance chambers and retard chambers, an advance line in fluid communication with the advance chamber and leading to a cam bearing area of the camshaft, and a retard line in fluid communication with the retard chamber and leading to the cam bearing area of the camshaft. A cam bearing supports the cam bearing area around the camshaft and has ports aligned with the advance line and the retard line. A plurality of seals are located inside the cam bearing. At least one seal is between the ports to the advance line and the retard line, and a pair of seals are on opposite sides of the ports aligned with the advance and retard line. A control system is located separately from the phaser.

8 Claims, 6 Drawing Sheets

PROIR ART

VARIABLE CAMSHAFT TIMING SYSTEM WITH REMOTELY LOCATED CONTROL SYSTEM

BACKGROUND OF THE INVENTION

1. Field of the Invention

The invention pertains to the field of variable camshaft timing systems. More particularly, the invention pertains to a variable camshaft timing system with a remotely located control system.

2. Description of Related Art

Cam torque actuated (CTA) phasers are sensitive to leakage due to the use of smaller chambers with smaller volumes than in an oil pressure actuated phaser. To reduce the leakage and to shorten the flow path chamber to chamber, the check valves and the spool valve are centrally mounted within the phaser.

However, in certain applications, the overall length of the variable cam timing (VCT) system, including the spool valve actuator that is typically mounted in front of the VCT, was too long for placement in the vehicle. One solution to shortening the overall length of the variable cam timing system is to remotely locate the spool valve and check valves or control of the cam torque actuated phaser. However, in order to locate the CTA control system remote from the phaser, it is necessary to transfer the fluid across the camshaft bearing. The camshaft bearing has a certain free running clearance that introduces leakage to the VCT system and thus reduces the performance of the system.

Leakage also occurs within the CTA system since the head is aluminum and expands faster than the iron camshaft, therefore any clearances between the head and the camshaft increase as the temperature of the engine increases.

Therefore, there is a need in the art for a VCT system that shortens the overall length of the variable cam timing system by using a remote control valve and controls leakage of the phaser.

SUMMARY OF THE INVENTION

A VCT system for an internal combustion engine having at least one camshaft and a VCT phaser mounted to the camshaft. The phaser having a plurality of advance chambers and retard chambers, an advance line in fluid communication with the advance chamber and leading to a cam bearing area of the camshaft, and a retard line in fluid communication with the retard chamber and leading to the cam bearing area of the camshaft. A cam bearing supports the cam bearing area around the camshaft and has ports aligned with the advance line and the retard line. A plurality of seals are located inside the cam bearing. At least one seal is between the ports to the advance line and the retard line, and a pair of seals are on opposite sides of the ports aligned with the advance and retard line. The seals prevent leakage from the phaser and between the advance chamber and the retard chamber. A control system is located separately from the phaser. The control system comprises a valve for selectively blocking and allowing fluid flow unidirectionally from the ports to the advance line or the ports to the retard line.

Alternatively, the cam bearing supporting the cam bearing area around the camshaft, has ports aligned with the advance line and the retard line, and is surrounded by a sleeve with a same coefficient of thermal expansion. The sleeve and the camshaft may be made of the same material.

DETAILED DESCRIPTION OF THE INVENTION

Internal combustion engines have employed various mechanisms to vary the angle between the camshaft and the crankshaft for improved engine performance or reduced emissions. The majority of these variable camshaft timing (VCT) mechanism use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the housing, and the chambers in the rotor, as well. The housing's outer circumference forms the sprocket, pulley or gear accepting drive force through a chain, belt, or gears, usually from the camshaft, or possible from another camshaft in a multiple-cam engine.

Figure 1A:
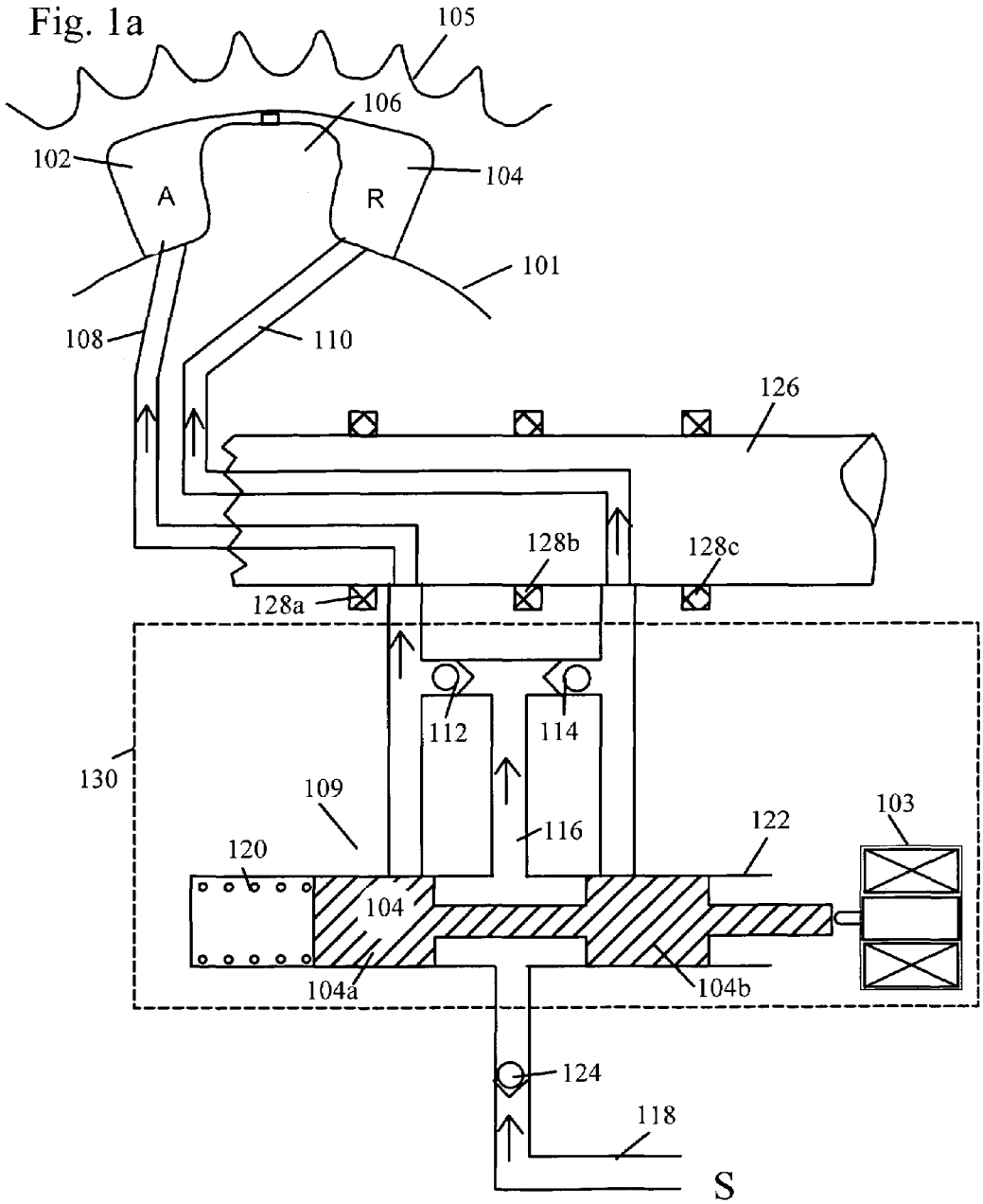
FIG. 1*a* shows a schematic of the phaser of the present invention in the null position.

FIG. 1*a* shows a schematic of the phaser of the present invention in the null position. Hydraulic fluid enters line 118 from a pressurized source to the remotely or separately located control system from the rotor and housing, indicated in the figure by dashed box 130. The control system 130 includes the spool valve 109, the actuator 103, common line 116, check valves 112, 114 and portions of advance line 108 and retard line 110. The spool valve 109 is comprised of a spool 104 with multiple lands 104*a*, 104*b* slidably received by bore 122. One side of the spool 104 is biased by spring 120 and the other side of the spool 104 is biased by actuator 103. Advance and retard lines 108 and 110 lead from the remotely mounted control system 130, through the camshaft 126 to the advance chamber 102 and the retard chamber 104 located in the housing 105. Seals 128*a*, 128*b*, and 128*c* are located around the camshaft 126 at the interface between the variable cam timing (VCT) system and the remote control system 130. Specifically, outboard seals 128*a*, 128*c* limit the leakage of fluid within the cam torque actuated (CTA) VCT system to atmosphere and the seal 128*c* in the center of the advance and retard passages 108, 110 limits leakage of fluid from the advance chamber 102 to the retard chamber 104.

In the null position, fluid from the supply enters the spool valve 104 and moves through common line 116 and check valves 112, 114 to the advance line 108 and the retard line 110 respectively. From the advance line 108 and the retard line 110 fluid enters the advance chamber 102 and the retard chamber 104.

Figure 1B:
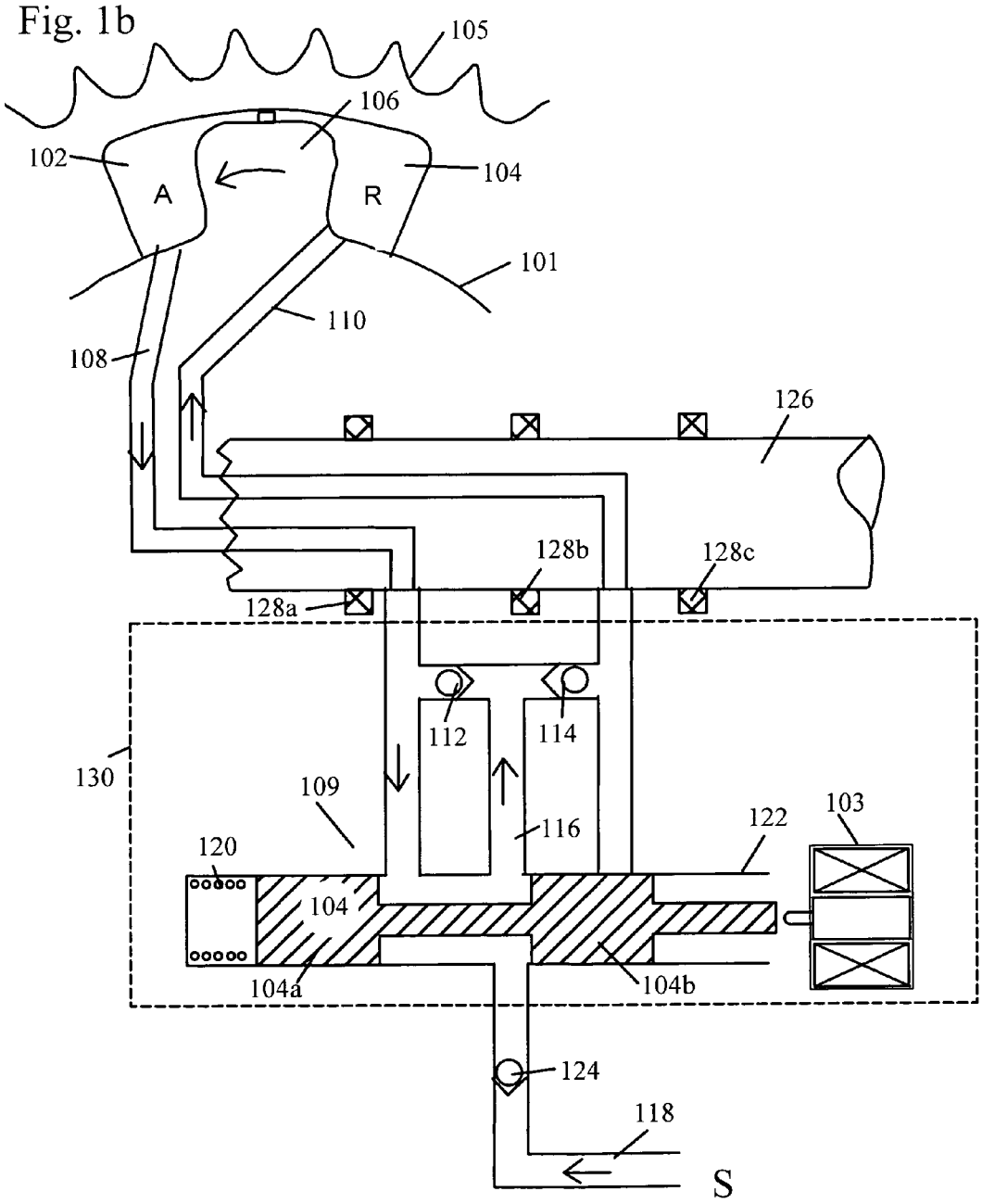
FIG. 1*b* shows a schematic of the phaser of the present invention in the retard position.

When the force of the spring 120 is less than the force of the actuator 103, the spool 104 is moved to the left, as shown in FIG. 1*b*, to the retard position. In the retard position, fluid exits the advance chamber 102 through advance line 108 and the camshaft 126 to the remote control system 130 and into the spool valve 109. Fluid in the spool valve 109 and from supply line 118 enters common line 116 and moves through check valve 114 to retard line 110 and to the retard chamber

104, forcing the vane 106 to move to the left as shown by the arrow. Spool land 104*b* blocks fluid from the retard chamber 104 from entering the spool valve 109. Check valve 114 does not allow fluid to exit from the retard chamber 104.

Figure 1C:
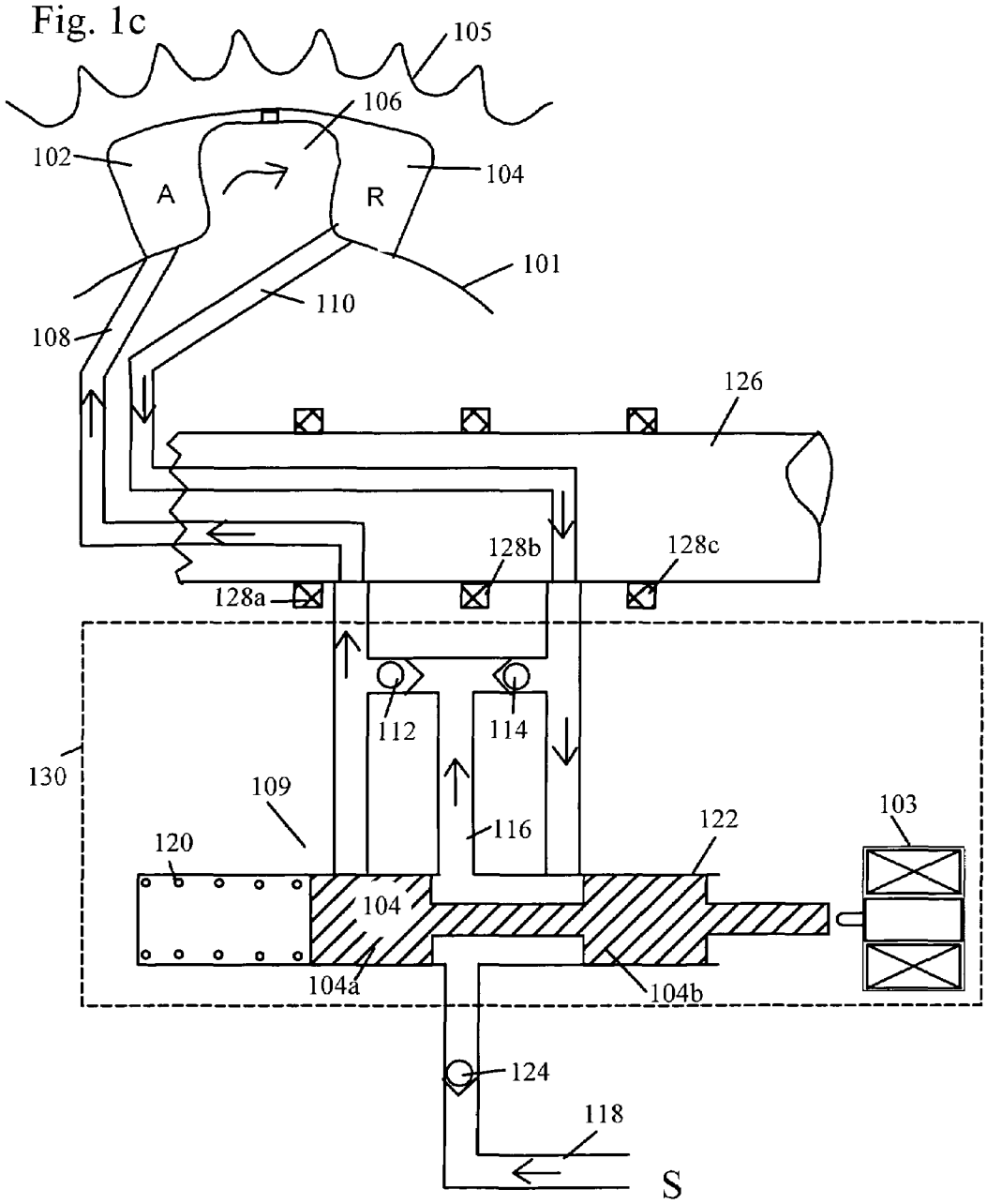
FIG. 1*c* shows a schematic of the phaser of the present invention in the advance position.

When the force of the actuator 103 is less than the force of the spring 120, the spool is moved to the right, as shown in FIG. 1*c*, to the advance position. In the advance position, fluid exits the retard chamber 104 through retard line 110 and camshaft 126 to the remote control system 130 and into the spool valve 109. Fluid in the spool valve and from supply line 118 enters the common line and moves through check valve 112 to advance line 108 and to the advance chamber 102, forcing the vane 106 to move to the right as shown by the arrow. Spool land 104*a* blocks fluid from the advance chamber 103 from entering the spool valve 109. Check valve 112 does not allow fluid to exit from the advance chamber 102.

Figure 2A:
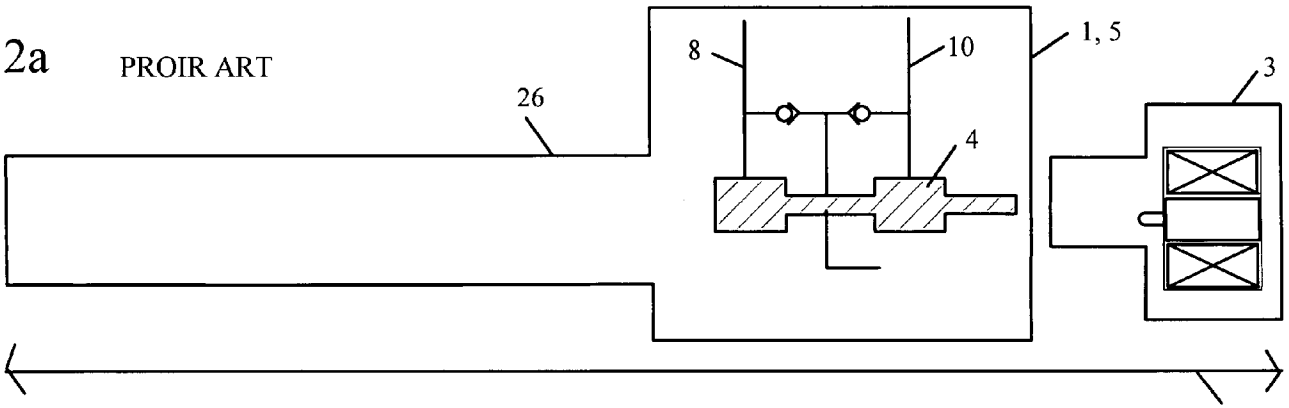
FIG. 2*a* shows the length of a prior art phaser in comparison to the phaser of the present invention in FIG. 2*b*.
Figure 2B:
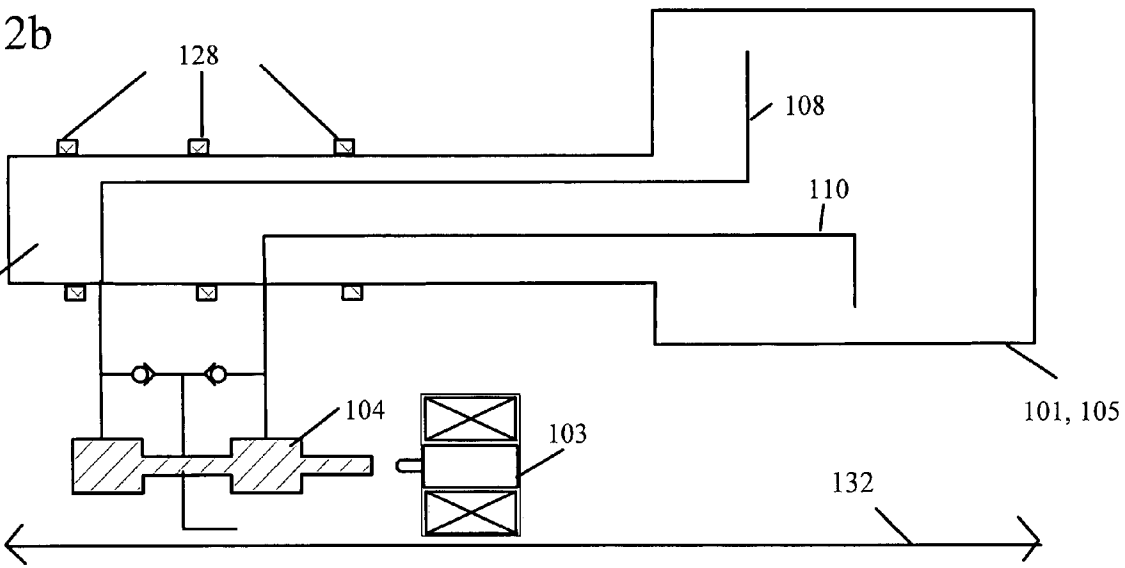

FIG. 2*a* shows a prior art phaser and its length 32. FIG. 2*b* shows the phaser of the present invention and its length 132. In comparison, the phaser in FIG. 2*b* has a considerably shorter length 132 than the prior art, since the control system is located remotely. Significant leakage that would render the phaser from performing is prevented by placement of seals 128*a*, 128*b* and 128*c*. Seals 128*a* and 128*c* limit the leakage of fluid within the cam torque actuated (CTA) VCT system to atmosphere and the seal 128*c* in the center of the advance and retard passages 108, 110 limits leakage of fluid from the advance chamber to the retard chamber.

The spool valve is not limited to the arrangement, shape, or number of lands of the spool shown in the figures. Furthermore, check valves 112 and 114 may be incorporated into the spool or spool valve as disclosed in application Ser. No. 10/952,054 filed Sep. 28, 2004 and entitled "CONTROL VALVE WITH INTEGRATED CHECK VALVES" and is hereby incorporated by reference. The actuator 103 may be hydraulic, electric, a differential pressure control system (DPCS), or a variable force solenoid (VFS).

Alternatively, check valve 124 may be present in supply line 118 to limit pressure feedback to the oil supply system.

The check valves may be comprised of a ball and a seat, as shown in the figures, or other types of check valves may used, including band check valves, disc check valves, and cone-type.

The term "remote" as used in this application is to mean separate from the housing and the rotor.

Figure 3:
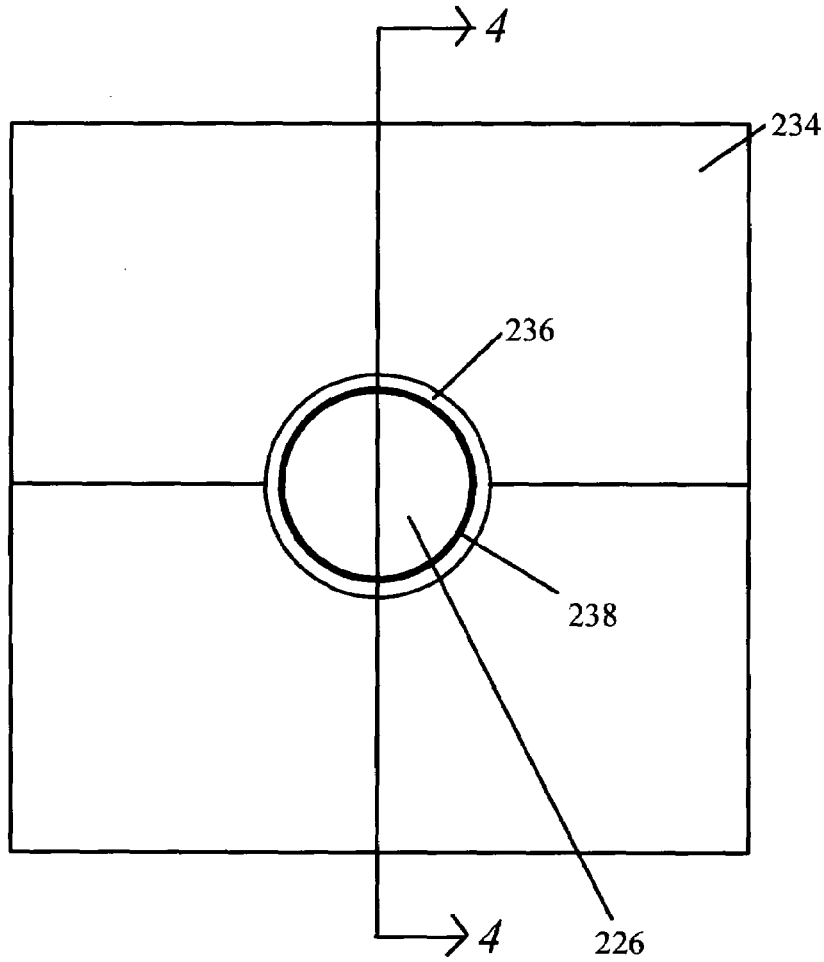
FIG. 3 shows a schematic of an alternative embodiment.
Figure 4:
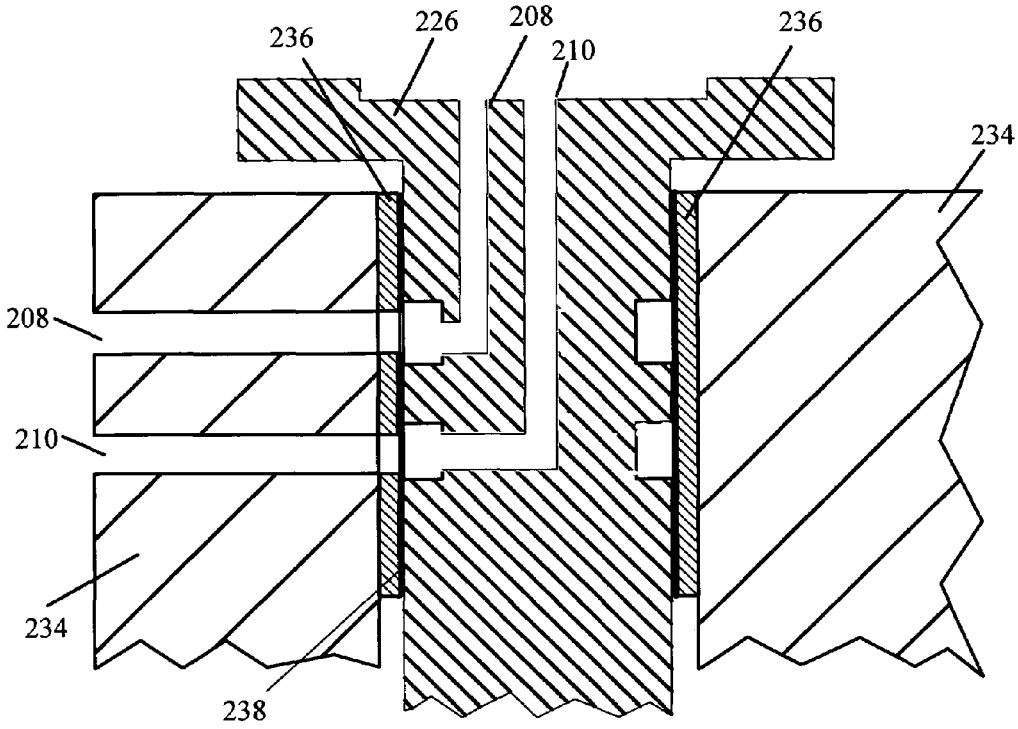
FIG. 4 shows a schematic of a cross-section of FIG. 3 along line 4—4.

FIGS. 3 and 4 show schematics of an alternative embodiment. As discussed in the prior art, the cylinder head and the camshaft are made of different materials, each with a different coefficient of thermal expansion, so as the temperature in the engine increases, the aluminum cylinder head expands faster than the iron camshaft. Since the cylinder head directly surrounds the camshaft, clearances in the camshaft expand as the cylinder head expands.

Referring to FIG. 4, the camshaft and mounting flange, which is attached to a phaser, contains passages 208, 210 to the advance and retard chambers (not shown) on either side of the vane, to deliver fluid from the control system 130 of FIGS. 1*a* through 1*c* to the chambers and run through the camshaft 226 and cylinder head 234. To prevent expansion of clearances in the camshaft 226 from occurring, the camshaft 226 is surrounded by a steel sleeve 236 and the cylinder head 234 as shown in FIGS. 3 and 4. So, as the temperature of the engine increases, the aluminum cylinder head expands, however, since the steel camshaft 226 is surrounded by the steel sleeve 236, the steel sleeve 236 and camshaft 226 expand at the same slower rate, preventing any clearances in the camshaft 226 from expanding, as in the prior art and reducing or eliminating the need for seals as in the previous embodiment shown in FIGS. 1*a* through 2.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system for an internal combustion engine having at least one camshaft and a variable cam timing (VCT) phaser mounted to the camshaft having a plurality of advance chambers and retard chambers and an advance line in fluid communication with the advance chamber and leading to a cam bearing area of the camshaft and a retard line in fluid communication with the retard chamber and leading to the cam bearing area of the camshaft, the variable cam timing system comprising:

a cam bearing supporting the cam bearing area around the camshaft, having ports aligned with the advance line and the retard line, and is surrounded by a sleeve with a same coefficient of thermal expansion;

a control system located separately from the phaser, comprising a valve, for selectively blocking and allowing fluid flow unidirectionally from the ports to the advance line or the ports to the retard line.

2. The variable cam timing system of claim 1, wherein the sleeve and the camshaft are made of the same material.

3. The variable cam timing system of claim 2, wherein the material is steel.

4. The variable cam timing system of claim 1, wherein the control system further comprises an actuator.

5. The variable cam timing system of claim 1, wherein the valve is a spool valve.

6. The variable cam timing system of claim 1, further comprising a line from a source of pressurized fluid to the control system.

7. The variable cam timing system of claim 6, wherein the line further comprises a check valve.

8. The variable cam timing system of claim 6, further comprising a pair of check valves between the source and the advance line and the retard line in the control system.

* * * * *